US006126282A

United States Patent [19]

Oikawa

[11] Patent Number: 6,126,282

[45] Date of Patent: Oct. 3, 2000

[54] INK-JET RECORDING APPARATUS AND METHOD THEREOF

[75] Inventor: Masaki Oikawa, Kodaira, Japan

[73] Assignee: Canon Kabushiki Kaisha, Tokyo, Japan

[21] Appl. No.: 09/215,192

[22] Filed: Dec. 18, 1998

[30] Foreign Application Priority Data

Dec. 26, 1997 [JP] Japan ..... 9-361428

[51] Int. Cl.[7] ..... B41J 2/01

[52] U.S. Cl. ..... 347/101; 347/37; 347/47; 347/98

[58] Field of Search ..... 347/6, 7, 21, 22, 347/28, 37, 47, 95, 96, 98, 101

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,538,160 | 8/1985 | Uchiyama | 347/101 |
| 4,558,333 | 12/1985 | Sugitani et al. | 346/140 |
| 4,608,577 | 8/1986 | Hori | 346/140 |
| 4,723,129 | 2/1988 | Endo et al. | 346/1.1 |
| 4,740,796 | 4/1988 | Endo et al. | 346/1.1 |
| 5,618,338 | 4/1997 | Kurabayashi et al. | 347/101 |
| 5,623,294 | 4/1997 | Takizawa et al. | 347/98 |
| 5,635,969 | 6/1997 | Allen | 347/96 |
| 5,640,187 | 6/1997 | Kashiwazaki et al. | 347/101 |
| 5,644,350 | 7/1997 | Ando et al. | 347/101 |
| 5,975,679 | 11/1999 | Nicoloff, Jr. et al. | 347/37 |
| 5,992,968 | 11/1999 | Uetsuki et al. | 347/37 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Eugene Eickholt
*Attorney, Agent, or Firm*—Fitzpatrick, Cella, Harper & Scinto

[57] ABSTRACT

An ink-jet recording apparatus of the present invention is for eliminating the difference in printed results generated from an offset between the positions to which a main drop and satellite drop of ink are discharged respectively, and generated also from the difference in the ejecting order of processing liquid with respect to ink. The apparatus is constructed such that in a scanning operation in which a satellite ink drop Da2 is dropped onto a main ink drop Da1 ejected from the ink head section in a superimposed manner, the processing liquid Sa falls after the ink dot formed on the recording paper 16 is expanded to some extent, whereas in a scanning operation in which the satellite drop Db2 is dropped at a position offset from the position of the main drop Db1, the processing liquid Sb is first ejected, and those ink drops Db1 and Db2 are discharged thereafter, so as to suppress expansion of the ink dot, making thus a dot having substantially the same size with that formed in the above scanning case.

5 Claims, 6 Drawing Sheets

INK-JET RECORDING APPARATUS AND METHOD THEREOF

This application is based on Patent Application No. 361,428/1997 filed on Dec. 26, 1997 in Japan, the content of which is incorporated by reference.

BACKGROUND OF THE INVENTION

1. Field of the Invention

The present invention relates to an ink-jet recording apparatus for recording data on a recording medium by ejecting ink thereon, as well as an ink-jet recording method, and more particularly to an ink-jet recording apparatus and method for recording data through making the color element of ink insoluble or coagulated.

2. Description of the Related Art

It is gradually getting known that a conventional ink-jet recording apparatus adopts recording liquid such as ink (hereinafter may be referred to just as ink), and processing liquid that reacts with the color element in ink and makes it either insoluble or coagulated, with a view to improving the water-resisting property and image quality thereof. The processing liquid is crystal clear, and is mixed with ink by ejecting on or to a nearby area of ink to generate the above-mentioned reaction. By using such processing liquid, the color productivity and water-resisting property of ink fixed on a recording medium is improved, and generation of bleeding phenomenon can be avoided. Specially in a case in which a recording medium which is not coated with ink-receiving layer or the like is used, in other words, a widely diffused normal paper sheet or the like is used, a data recording free of bleeding is enabled and a great effect can thus be obtained.

By the way, when ink is ejected, there are occasions that a satellite ink drop is generated following the main drop thereof, and it is also conventionally known that in such a case, if the ejecting direction or angle of the main ink drop and that of the satellite ink drop is different from each other, an adverse effect is caused to the printed result.

FIG. 5 is an exemplary view that indicates a state in which ink is being ejected, and explains the difference between the ejecting direction and angle of the main drop and those of the satellite drop. As shown in FIG. 5, a bubble 4 is generated by rapidly heating up a heater 3 provided in the liquid flowing path of the recording head, and the main drop D1 is ejected in due course. Thereafter, when the meniscus of ink recedes in accordance with collapse of the bubble 4, the satellite drop D2 is generated. Generally, ejecting speed of satellite drops is slower than that of main drops. Also, as shown in FIG. 5, if the meniscus recedes in somewhat an eccentric manner due to the shape of an ejection nozzle, the satellite drop is ejected in the direction H2 which is different from the direction H1 in which main drop is discharged. In this way, the main and satellite drops, whose ejecting speeds are different from each other, are generated.

As explained heretofore, when a reciprocal printing is performed by scanning the recording head in each of the both rightward and leftward directions in a state that the ejecting speed and angle of the respective main drop and satellite drop are different, the following problems are likely to occur. Note that the rightward scanning may be referred to as normal scanning, and the leftward scanning may be referred to as reverse scanning throughout the present specification.

FIG. 3A shows a state in which the ejecting direction of the satellite drop is converted to the direction which is opposite to the scanning direction with respect to the main drop ejecting direction. In this case, since the offset of the scanning direction of the recording head and that of the satellite drop is opposite to each other and the ejecting speed is thus slow, the satellite drop Da2 is more affected by the scanning speed than the main drop Da1 is. Accordingly, the direction of the main drop and that of the satellite drop become substantially the same, and are dropped onto the substantially same positions Da1' and Da2' on the recording medium in a superimposed manner. That is, the offset of the ejecting direction of the satellite drop with respect to the main drop is compensated by the scanning speed of the recording head.

On the other hand, as shown in FIG. 3B, when the recording head is scanned in the reverse direction, in other words, when the ejecting direction of the satellite drop is converted to the same direction as that of the scanning of the recording head with respect to the main drop ejecting direction, the satellite drop Db2 whose speed is rather slow is likely to receive the effect of the reverse scanning speed of the recording head than the main drop Db1 receives, whereby the offset between the ejecting direction of the main drop and that of the satellite drop during the printing operation becomes substantially more expanded, and they fall, in fact, on two distinctly different points Db1' and Db2' on the recording medium 2. On this occasion, the dots printed on the respective two different points appear, as shown in the lower section of each of FIGS. 3A and 3B, as of different size and shape, and as a result they appear in different size of character as a whole, causing thereby a problem in its printing quality.

In order to solve the problems aforementioned, there has been proposed so far a method for equalizing the ejecting direction of the both main drop and satellite drop through modification of shape of the record liquid flowing path, or by correcting the angle and/or the position of the orifice provided in the recording head. However, due to the above corrections, the ejecting angle is varied as a whole, and accordingly the dot forming positions become different per each nozzle row, and also size of the orifice area is made smaller and so forth. Further, even though the ejecting directions of the main drop and that of the satellite drop are equalized, correction of the difference in the ejecting speeds thereof is theoretically difficult, and thus there has been an attempt to avoid the positional difference between the dot formed in the normal scanning of the recording head and that formed in the reverse scanning, for example by inclining the recording head or the like, in order to make the dot shapes thereof substantially the same, which, however, was not totally available as the total cost was thereby increased.

Apart from the above-explained problems caused during the reciprocal scanning of the recording head for printing, there has also been such a problem that in a case in which both processing liquid and recording liquid (or ink, in this case) are used for printing operation, and the recording head is provided with only one nozzle row, in one of the reciprocal scanning movements, the processing liquid is ejected before ink (which is called "primary ejection" of the processing liquid), whereas in the other movement, ink is ejected before the processing liquid (which is called "secondary ejection" of the processing liquid). In the case of the secondary ejection, since ink as the recording liquid is ejected first, the dot formed thereby is often blurred with ink, and thus becomes larger than that in the case of the primary ejection, which is explained with reference to FIGS. 4A and 4B.

FIG. 4A shows the case in which ink is ejected before the processing liquid (namely, the secondary ejection), while FIG. 4B shows the case in which the processing liquid is ejected before ink (namely, the primary ejection). In FIG. 4A, ink is first ejected as shown in (a), but it is spread before ejection of the processing liquid as shown in (b) because of its high permeability. Thereafter, the processing liquid is ejected as shown in (c), and the dot is thereby fixed finally as shown in (d). The diameter of the dot formed by these procedures is shown in the lower part of FIG. 4A. Contrary to this, as shown in FIG. 4B, the processing liquid is first ejected as shown in (a), but it is not spread so much because of its smaller dot diameter and lower permeability than those of ink. Thereafter, ink is ejected thereon as shown in (b), and the dot is thereby fixed finally as shown in (c). The diameter of the dot formed by these procedures is shown in the lower part of FIG. 4B.

As is obvious from the difference in diameters of each dot by FIGS. 4A and 4B, the dot diameter is formed differently depending on which of the processing liquid and ink is ejected first. This is one of the reasons for the difference in printed results, namely, the difference in the size of character letters or the like, caused by the normal scanning and by the reverse scanning.

In order to solve the aforementioned problems, there has been proposed a method in which the permeability of ink is suppressed. However, if this method is taken, a such problem that fixing characteristic of ink is deteriorated and ink is thus likely to become solid and so on have been caused. There has been proposed also a method in which ink and processing liquid are discharged from two nozzle rows, but was not completely available either because of an increase in cost.

SUMMARY OF THE INVENTION

The present invention has been achieved to solve the above-described problem and an object of the present invention is to provide an ink-jet recording apparatus and an ink-jet recording method capable of performing a high-quality printing without making difference in the diameters of dots respectively formed by the normal and reverse movements in the reciprocal recording head scanning operations, by offsetting the difference in dot diameters generated due to the satellite drops and that generated due to the difference in ejecting order of the processing liquid and ink.

In order to solve the problems aforementioned, an ink-jet recording apparatus using an ink head section for ejecting ink and processing liquid head section for making ink ejected from the ink head section insoluble or coagulated is constructed such that it comprises: a head-section scan driving means that reciprocally drives the ink-head section and processing-liquid head section with respect to a recording medium, and means for ejecting processing liquid from the processing liquid head section after the ejection of ink conducted by said ink head section, in a state that a satellite drop of ink following the ejection of a main drop of ink is ejected in the different direction from that of the main drop, if the different direction is opposite to the scanning direction of the ink head section, and for ejecting processing liquid from the processing liquid head section prior to the ejection of ink conducted by the ink head section, if the different direction is same as the scanning direction of the ink head section.

In the ink-jet recording apparatus as constructed above, the ink head section is provided with a plurality of ink tanks, each having different colors, which ink tanks are mounted in parallel along the recording medium transferring direction which intersects with the scanning direction.

Further, in the ink-jet recording apparatus, the ink head section and the processing liquid head section generate bubbles respectively to the ink and processing liquid by use of thermal energy, and discharge respectively the ink and processing liquid by pressure of the bubbles. It is to be noted that the satellite drop is generated when meniscus of ink recedes in accordance with collapse of the bubbles.

Still further, an ink-jet recording method according to the present invention is provided for recording on a recording medium, using an ink head section for ejecting processing liquid that makes the ink ejected from the head section insoluble or coagulated, by reciprocating the ink head section and the processing liquid head section, wherein the ink-jet recording method comprises the steps of: reciprocally driving the ink head section and the processing liquid head section with respect to the recording medium, ejecting processing liquid from the processing liquid head section after the ejection of ink conducted by the ink head section, in a state that a satellite drop of ink following the ejection of a main drop of ink is ejected in the different direction from that of the main drop, if the different direction is opposite to the scanning direction of the ink head section, and ejecting processing liquid from the processing liquid head section prior to the ejection of ink conducted by the ink head section, if the different direction is same as the scanning direction of the ink head section.

By the above construction, in a case in which a satellite drop of ink which is discharged from the recording head is ejected in the different direction from that of a main drop, if the different direction is opposite to the scanning direction of the recording head, the processing liquid is ejected after the ejection of ink, whereas if the different direction is same as the scanning direction of the recording head, the processing liquid is ejected prior to the ejection of ink. Due to the above procedure, the ink dot formed by the former scanning movement, the main drop and the satellite drop are formed in a superimposed manner, and the dot expansion can be secured prior to the ejection of the processing liquid, so that a relatively large dot can be formed, whereas in the latter scanning movement, although the ejected ink immediately reacts with the processing liquid and the dot expansion is thereby suppressed, since the positions at which the main and satellite drops fall are different from each other, the dot having the same size with that formed by the former scanning movement can be formed.

As a result of these procedures, an ink-jet recording apparatus capable of performing a high-quality printing without making difference in the diameters of dots respectively formed by the former (normal) and the latter (reverse) movements in the reciprocal recording head scanning operations.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention is now explained into details with reference to the attached drawings.

Figure 6:
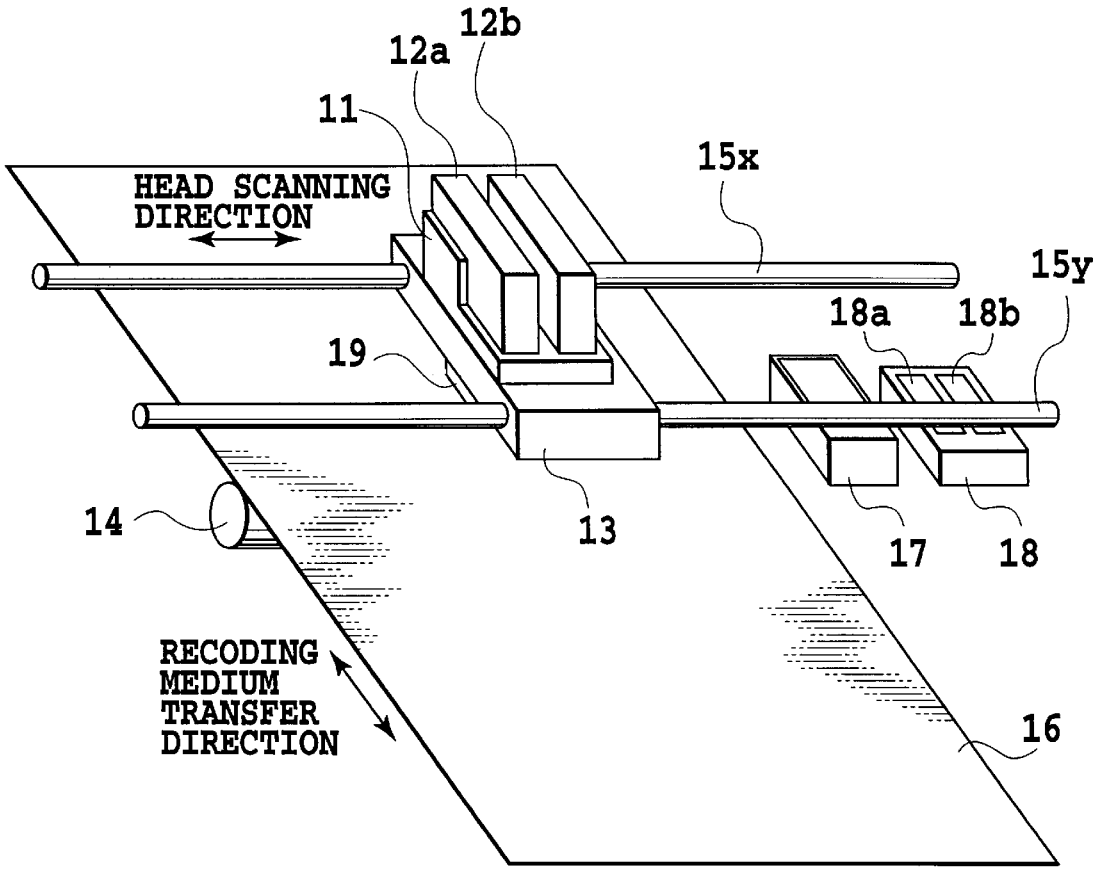
FIG. 6 is a perspective view showing a basic configuration of an important portion of a printer according to one embodiment of an ink-jet recording apparatus of the present invention.

FIG. 6 is a perspective view showing a basic configuration of an important portion a printer according to one embodiment of an ink-jet recording apparatus of the present invention.

In the figure, reference numeral 11 denotes a head cartridge, which includes an ink-jet recording head section 19, and is capable of accommodating a processing liquid tank 12*a* and an ink tank 12*b* thereon. Reference numeral 13 is a carriage that receives the cartridge 11 and transfers it along the guide shafts 15*x* and 15*y* so as to scan in the recording head scanning direction.

Figure 7A:
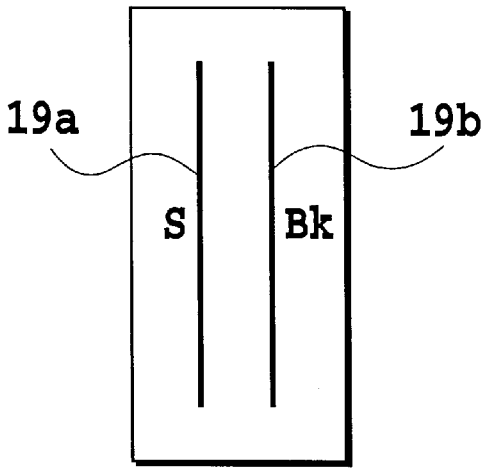
FIGS. 7A and 7B are schematic views observed from the ejection-side surface of the recording head used in the printer of FIG. 6.
Figure 7B:
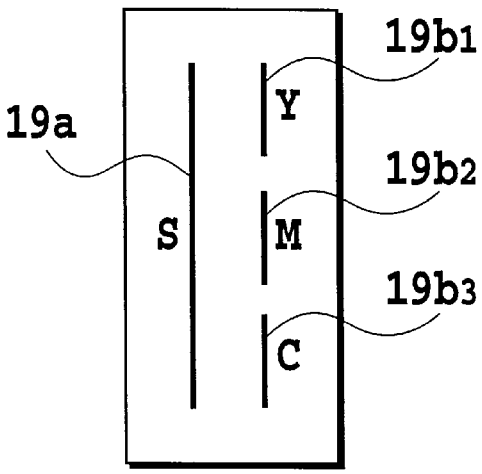

FIGS. 7A and 7B are schematic views of the recording head section 19 observed from the recording medium (or recording paper 16) side. As shown in these figures, the recording head section 19 contains two rows of orifices (or just two nozzle rows); namely 19*a* and 19*b*, of which nozzle rows, 19*a* is a nozzle row for ejecting processing liquid and can be called a processing liquid head section, whereas 19*b* is a nozzle row for ejecting ink and can be called an ink head section.

The printer according to the present embodiment can, as shown in FIGS. 7A and 7B, replace two types of head cartridges with each other, wherein the cartridge shown in FIG. 7A ejects BK (black) ink from the nozzle row 19*b*, and the cartridge shown in FIG. 7B ejects ink of three colors; namely Y (yellow), M (magenta) and C (cyan), respectively from the nozzle row $\mathbf{19}b_1$, $\mathbf{19}b_2$ and $\mathbf{19}b_3$. By replacing these two types of cartridges on demands, both documents and color graphics can be printed.

It is to be noted that although the present embodiment is constructed as explained heretofore, the application of the present invention is not limited to the construction of the above carriage and recording head, but can also be applied to the case in which two or more than two head cartridges are used. Further, the head cartridge used here can be the one that comprises one nozzle row for each color. Still further, it can be the head cartridge that contains a plurality of nozzle rows.

Referring back to FIG. 6 again, reference numeral 16 denotes recording paper 16 as a recording medium, numeral 14 denotes a carriage roller for driving the recording paper 16 in the recording medium transfer direction in FIG. 6. It is to be noted that the carriage roller 14 is provided with a pinch roller (not shown) for sandwiching the recording paper therebetween.

As shown heretofore, printing on the whole area of the recording paper is accomplished by alternating ejection of the processing liquid or ink from the above nozzle rows, which is conducted during the time period in which the recording head is shifted in the scanning direction for recording operation, and transfer of the recording paper.

Reference numeral 18 denotes a cap made of resilient material such as rubber, which faces the nozzle surface of the recording head section when the recording head is at its home position, and is supported in such a manner as to enable attachment to and/or detachment from the recording head. This cap 18 is used for protecting the recording head when not used, removing the fixed processing liquid and ink, removing the bubble remained in the nozzles and liquid chamber, and also for conducting an ejection recovering process in which remained ink is forcibly absorbed and/or discharged by an absorbing pump (not shown).

Since the recording head for ejecting both processing liquid and ink is used in this embodiment, cap 18 is divided into cap sections 18*a* and 18*b* respectively corresponding to the processing liquid and ink, and this is because the ink and processing liquid are fixed when they are mixed, and it becomes quite difficult to remove them thereafter. Reference numeral 17 denotes an ink-discharging orifice for preliminary ejection of ink executed as one step of the ink ejection recovering process.

Figure 1A:
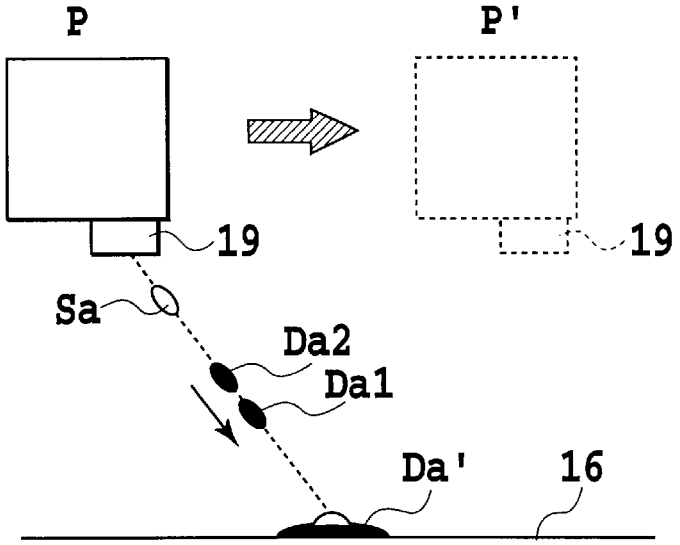
FIGS. 1A and 1B are exemplary views showing the ejection and landing of ink and those of processing liquid according to a first embodiment of the present invention, during the scanning movement of the recording head in which ink is ejected prior to the processing liquid, and during the reverse scanning movement of the recording head in which ink is ejected after the processing liquid, respectively.
Figure 1B:
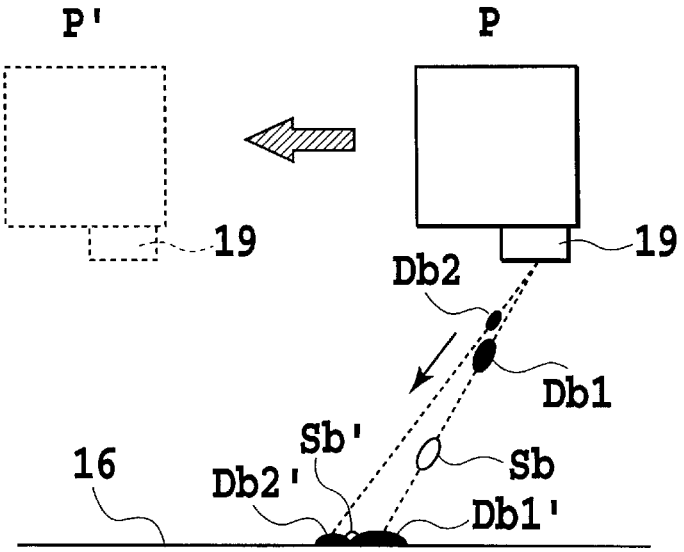
Figure 2A:
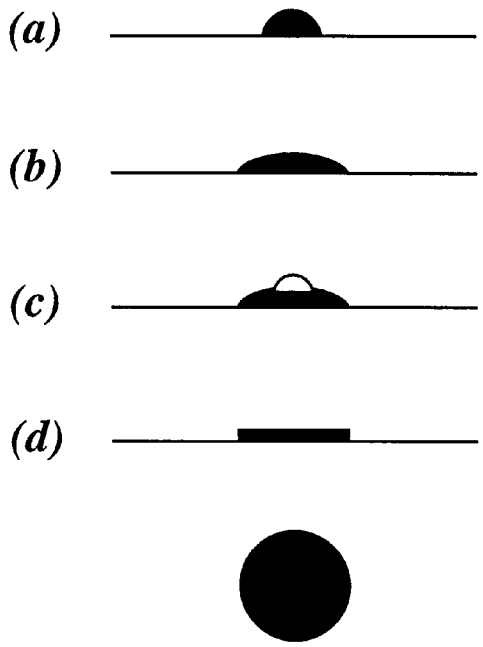
FIGS. 2A and 2B are schematic views showing how the dot is formed, respectively in the case of FIG. 1A and in the case of FIG. 1B.
Figure 2B:
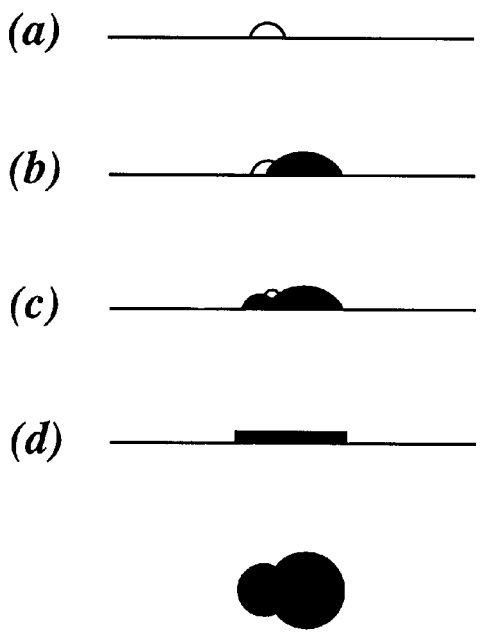
Figure 3A:
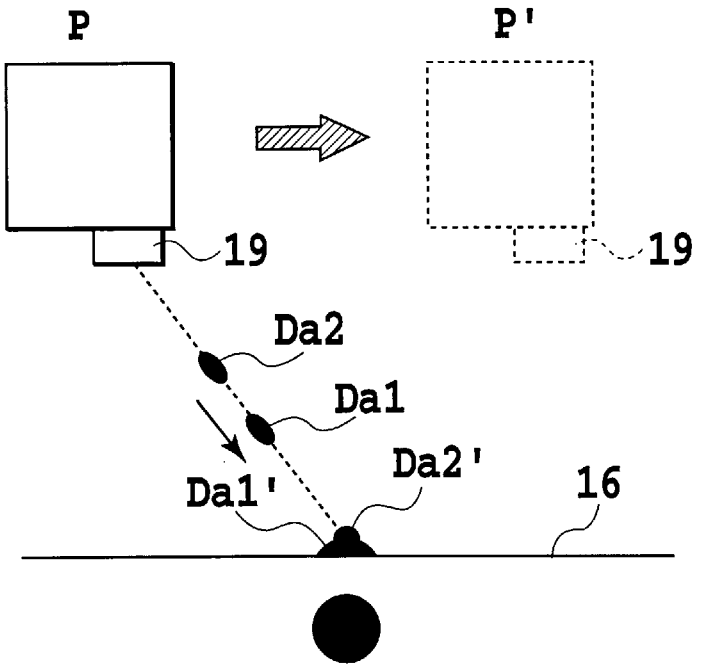
FIG.3A PRIOR ART
FIGS. 3A and 3B are exemplary views showing the ejection and landing of ink and those of processing liquid according to the prior art, respectively during the scanning movement and reverse scanning movement of the recording head.
Figure 3B:
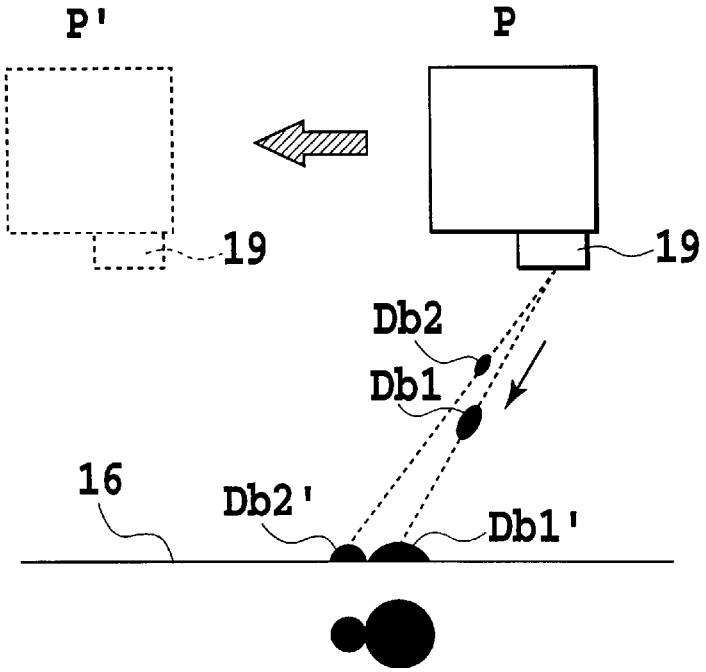
FIG.3B PRIOR ART
Figure 4A:
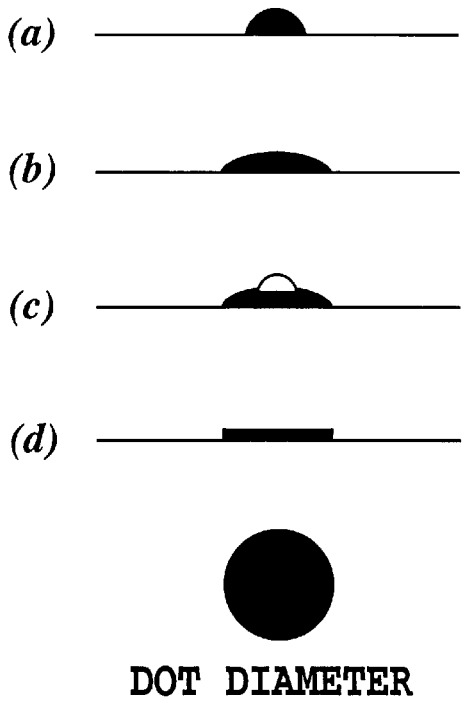
FIG.4A PRIOR ART
FIGS. 4A and 4B are exemplary views showing how the dot is formed according to the prior art, during the scanning movement of the recording head in which ink is ejected prior to the processing liquid, and during the reverse scanning movement of the ink-jet recording head in which ink is ejected after the processing liquid, respectively.
Figure 4B:
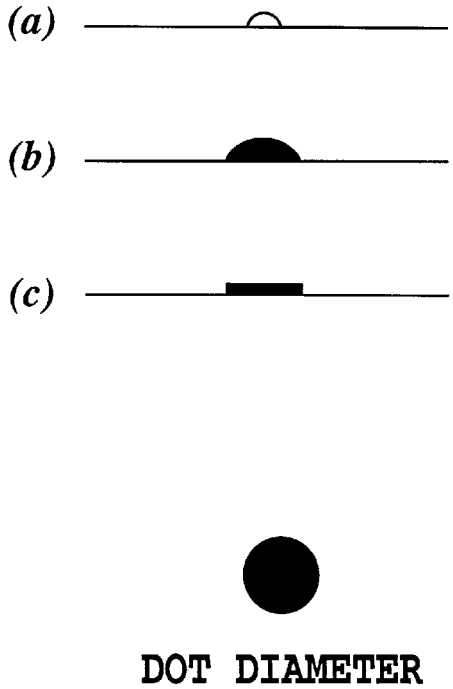
FIG.4B PRIOR ART
Figure 5:
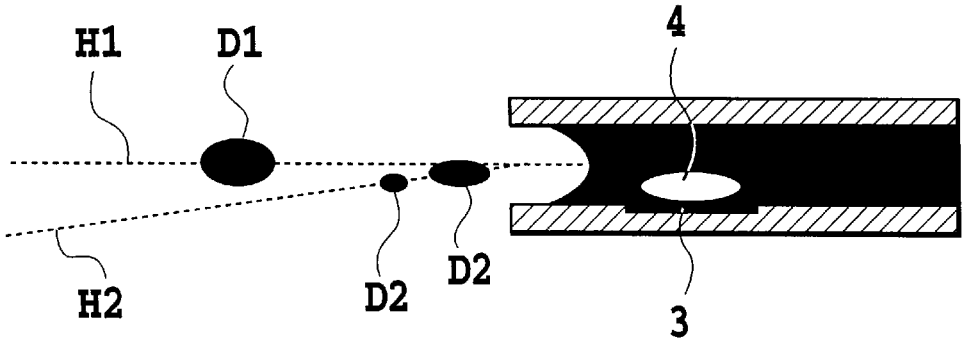
FIG. 5 is a schematic view showing how the main and satellite drops are generated during the ink jetting operation from the recording head.

FIGS. 1A and 1B are exemplary views showing the ejection and landing of ink and those of processing liquid, respectively during the normal and reverse scanning movements of the recording head. Further, FIG. 2A shows a dot forming process during the scanning in the direction shown in FIG. 1A, whereas FIG. 2B shows a dot forming process during the scanning in the direction shown in FIG. 1B. The reciprocal printing process according to the present embodiment of the present invention is now explained referring to FIGS. 1A, 1B, 2A and 2B as shown below.

First, in a case in which processing liquid is ejected after the ejection of ink (the before-explained secondary ejection), the main drop Da1 is ejected, which is followed by the ejection of satellite drop Da2, during the time interval in which the recording head 19 is shifted from the position P to position P'. On this occasion, the satellite drop Da2 is ejected on to the position of the main drop to form an ink drop Da', and then the processing liquid Sa is ejected onto the thus formed ink drop Da'. The dot forming procedure in this case is as follows. In FIG. 2A, first of all, the ink dropped as indicated in (a) is spread as indicated in (b). Then, the processing liquid is ejected onto the ink as indicated in (c), and as indicated in (d), the processing liquid is finally fixed. The dot diameter of this case is shown in the lower section of the same figure.

Thereafter, the recording head shifted to the position P' is scanned in the opposite direction to perform printing. In other words, processing liquid is ejected first as shown in FIG. 1B, and ink is ejected thereafter (the before-explained primary ejection). In this case, during the time interval in which the recording head is shifted to the position P', first the processing liquid Sb is ejected to form, liquid drop Sb' on the recording paper, and thereafter main drop Db1 and satellite drop Db2 of ink are ejected one after the other, in which case the satellite drop is ejected onto the different position from that of the main drop, forming ink drop Db1' and Db2', respectively.

The dot forming procedure in this case is as follows. In FIG. 2B, first of all, the processing liquid is first dropped as indicated in (a), and ink is ejected onto the processing liquid as indicated in (b). Thereafter, satellite drop of ink is ejected as indicated in (c), and finally the ejected ink is fixed as indicated in (d), as it is not spread this time. The dot diameter of this case is indicated in the lower section of FIG. 2B.

As is obvious from the dot diameters shown in FIGS. 2A and 2B, although the respective shapes are slightly different from each other, the dots formed by the normal and reverse movements in the reciprocal scanning operation of the recording head are of substantially the same size, and due to this, there is substantially no difference in the size and density of characters printed out in each of the normal and reverse scanning operations of the recording head, eliminating thus difference in dot diameters formed by the above reciprocal movement.

FURTHER DESCRIPTIONS

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high-resolution recording.

A typical structure and operational principle thereof is disclosed in U.S. Pat. Nos. 4,723,129 and 4,740,796, and it is preferable to use this basic principle to implement such a system. Although this system can be applied to both of on-demand type and continuous type ink-jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces abrupt temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal, so that the ejection of liquid (ink) having a quick driving response can be achieved. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type-recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a component of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers, or other type of heater elements, or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the ambient temperature and are softened or liquefied in the ambient temperature. This is because in the ink-jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink-jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet recording apparatus using an ink head section for ejecting ink, and processing liquid head section for making ink ejected from the ink head section insoluble or coagulated, said ink-jet recording apparatus comprising:

a head-section scan driving means that reciprocally drives said ink-head section and processing-liquid head section in a scanning direction with respect to a recording medium, and means for ejecting processing liquid from said processing liquid head section after the ejection of ink conducted by said ink head section, in a state that a satellite drop of ink following the ejection of a main drop of ink is ejected in a different direction from that of the main drop, if the different direction is opposite to the scanning direction of the ink head section, and for ejecting processing liquid from said processing liquid head section prior to the ejection of ink conducted by said ink head section, if said different direction is the same as the scanning direction of the ink head section.

2. An ink-jet recording apparatus as claimed in claim 1, wherein said ink head section is provided with a plurality of ink tanks, each having different colors, said ink tanks being mounted in parallel along a recording medium transferring direction which intersects with said scanning direction.

3. An ink-jet recording apparatus as claimed in claim 1, wherein said ink head section and said processing liquid head section generate bubbles respectively to said ink and processing liquid by use of thermal energy, and discharge respectively said ink and processing liquid by pressure of said bubbles.

4. An ink-jet recording apparatus as claimed in claim 3, wherein said satellite drop is generated when meniscus of ink recedes in accordance with collapse of said bubbles.

5. An ink-jet recording method for recording on a recording medium, using an ink head section for ejecting processing liquid that makes the ink ejected from the head section insoluble or coagulated, by reciprocating the ink head section and the processing liquid head section, said ink-jet recording method comprising the steps of:

reciprocally driving said ink head section and said processing liquid head section in a scanning direction with respect to the recording medium, ejecting processing liquid from said processing liquid head section after the ejection of ink conducted by said ink head section, in a state that a satellite drop of ink following the ejection of a main drop of ink is ejected in a different direction from that of the main drop, if the different direction is opposite to the scanning direction of the ink head section, and ejecting processing liquid from said processing liquid head section prior to the ejection of ink conducted by said ink head section, if said different direction is the same as the scanning direction of the ink head section.

* * * * *